US005199562A

United States Patent [19]

Adami et al.

[11] Patent Number: 5,199,562

[45] Date of Patent: Apr. 6, 1993

[54] MULTIPLE BOTTLE CARRIER

[75] Inventors: Arthur E. Adami, Andover, Mass.; Christopher P. Amberg, Owings Mills, Md.

[73] Assignee: Sweetheart Cup Company Inc., Owings Mills, Md.

[21] Appl. No.: 845,925

[22] Filed: Mar. 5, 1992

[51] Int. Cl.[5] ..... B65D 71/00

[52] U.S. Cl. ..... 206/151; 206/147; 294/87.2

[58] Field of Search ..... 206/139, 145, 147, 151, 206/158, 159, 160; 294/87.2, 87.22, 87.28

[56] References Cited

U.S. PATENT DOCUMENTS

| | | | |
|---|---|---|---|
| 3,387,879 | 6/1968 | Wood | 294/87.2 |
| 3,528,697 | 9/1970 | Wood | 294/87.2 |
| 4,326,628 | 4/1982 | Wood | 206/158 |
| 4,339,032 | 7/1982 | Wood | 206/158 |
| 4,360,231 | 11/1982 | Bolin | 294/87.2 |
| 4,372,599 | 2/1983 | Kiedaisch et al. | 294/87.2 |
| 4,460,084 | 7/1984 | Miller | 206/158 |
| 4,509,639 | 4/1985 | Thompson | 206/159 |
| 4,712,680 | 12/1987 | Panazzolo | 206/427 |
| 4,911,289 | 3/1990 | Bird | 206/150 |
| 4,917,428 | 4/1990 | Sola | 294/87.28 |
| 4,936,455 | 6/1990 | Bienaime | 206/427 |
| 5,096,246 | 3/1992 | Cnare | 294/87.2 |

FOREIGN PATENT DOCUMENTS

| | | | |
|---|---|---|---|
| 1423952 | 11/1965 | France | 294/87.2 |
| 2612496 | 9/1988 | France . | |
| 2221666 | 2/1990 | United Kingdom . | |

*Primary Examiner*—Jimmy G. Foster
*Attorney, Agent, or Firm*—Nixon & Vanderhye

[57] ABSTRACT

A self-locking bottle carrier is adapted to hold a number of bottles of the type having an annular neck flange protruding outwardly therefrom so as to allow the bottles to collectively be carried. The bottle carrier is most preferably a one-piece carrier body having a number of bottle-receiving apertures. These bottle receiving apertures are defined by a pair of opposed, generally horizontal support surfaces, and an opposed pair of resilient locking fingers. The locking fingers extend upwardly from respective ends of the horizontal support surfaces and converge towards one another so that an upper dimension of the aperture between the opposed locking fingers is less than a lower dimension of the aperture fingers near the support surfaces. The bottleneck flange is supported by the horizontal support surfaces such that the weight of the bottle and its contents cause these support surfaces to bow slightly downwardly which, in turn, urges the opposed locking fingers inwardly towards one another. As a result, the bottle received within each of the apertures is removably coupled to the carrier.

17 Claims, 3 Drawing Sheets

MULTIPLE BOTTLE CARRIER

CROSS-REFERENCE TO RELATED APPLICATIONS

This application is related to commonly owned U.S. Design patent application Ser. No. 07/845,338, filed even date herewith, the entire content of which is expressly incorporated hereinto by reference.

FILED OF INVENTION

The present invention relates generally to carriers for bottles. More specifically, the present invention is embodied in a carrier which accommodates multiple bottles of the type having a neck and an annular neck flange.

BACKGROUND AND SUMMARY OF THE INVENTION

Relatively large-sized beverage bottles (e.g., 2-liter bottles) formed of plastics material are typically sold individually to consumers. As a result, when multiple beverage bottles are desired to be purchased, they must be handled and/or carried separately. It would therefore be desirable to provide some assistance to the consumer to allow easier handling and/or carrying of multiple beverage bottles. Several proposals have been made in the art in an attempt to meet this desired result, as evidenced by U.S. Pat. Nos. 4,936,455 to Bienaime and 4,460,084 to Miller.

As will be noted in Bienaime '455, particularly FIG. 6 therein, a multiple bottle carrier is provided which is constructed from a single sheet of paperboard or plastics material. The carrier is formed by folding the interlocking portions so as to eliminate the need for glue. Tabs are provided within the bottle apertures which are forced upwardly when the bottles are inserted. Due to their resilient nature, these tabs are then biased back against the container thereby removably locking the bottle to the carrier.

A package for carrying two identical bottles is disclosed in Miller '084. The carrier is a two-part construction including a paperboard shroud having bottle apertures and a container securing member formed of a plastics material. The shroud is placed over the bottles and extends upwardly to the bottles' mid-portion. The first part of the carrier is then slipped over the bottle tops and rests on the shroud holding the bottles in alignment. The second part of the carrier is positioned on the lower portion of the shroud to provide additional support, as well as to prevent shroud separation from the bottles.

Although the prior art attempts to provide carriers for multiple bottles do appear to serve their intended functions, improvements are still needed, especially in the area of ensuring reliable coupling between the bottles and the carrier without providing significant obstacles to bottle removal. It is towards providing such improvements that the present invention is directed.

The present invention is most preferably embodied in a one-piece structure which accommodates multiple (e.g., at least two) beverage bottles of the type having an annular neck flange. The carrier body is in the form of an elongate inverted cup so as to provide a bounded interior space for covering an upper region of the bottles. The carrier body is, moreover, sufficiently elongate so as to accomodate at least two identical bottles in a side-by-side manner.

Bottleneck-receiving apertures are formed in the carrier body and provide the means by which the carrier body is coupled removably to the bottles. Each aperture is defined by a pair of opposed, generally horizontal support surfaces and an opposed pair of resilient locking fingers. The annular bottleneck flange rests upon, and is thus supported by, the opposed pair of support surfaces during handling and/or transport. The opposed pair of locking fingers, on the other hand, serve to removably lock the bottle to the carrier body by extending upwardly from the support surfaces in converging relationship to one another (i.e., so that the separation dimension between the opposed locking fingers is lesser at the top portion of the carrier body as compared to the separation dimension therebetween adjacent the support surfaces).

The weight of the bottles when carried will thus cause a slight downward bowing of the support surfaces. This slight bowing will, in turn, urge the opposed locking fingers to further converge towards one another which serves to lock the annular neck flange against the support surfaces. As a result, the bottle necks are reliably coupled to the carrier body. When the weight of the bottles is removed from the support surfaces (i.e., when not being carried), the support surfaces will resiliently return to their normal "non-bowed" condition which will likewise cause the locking fingers to return to their normal state where the bottles may more easily be removed.

Further aspects and advantages of this invention will become more clear after careful consideration is given to the following detailed description of the preferred exemplary embodiment.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
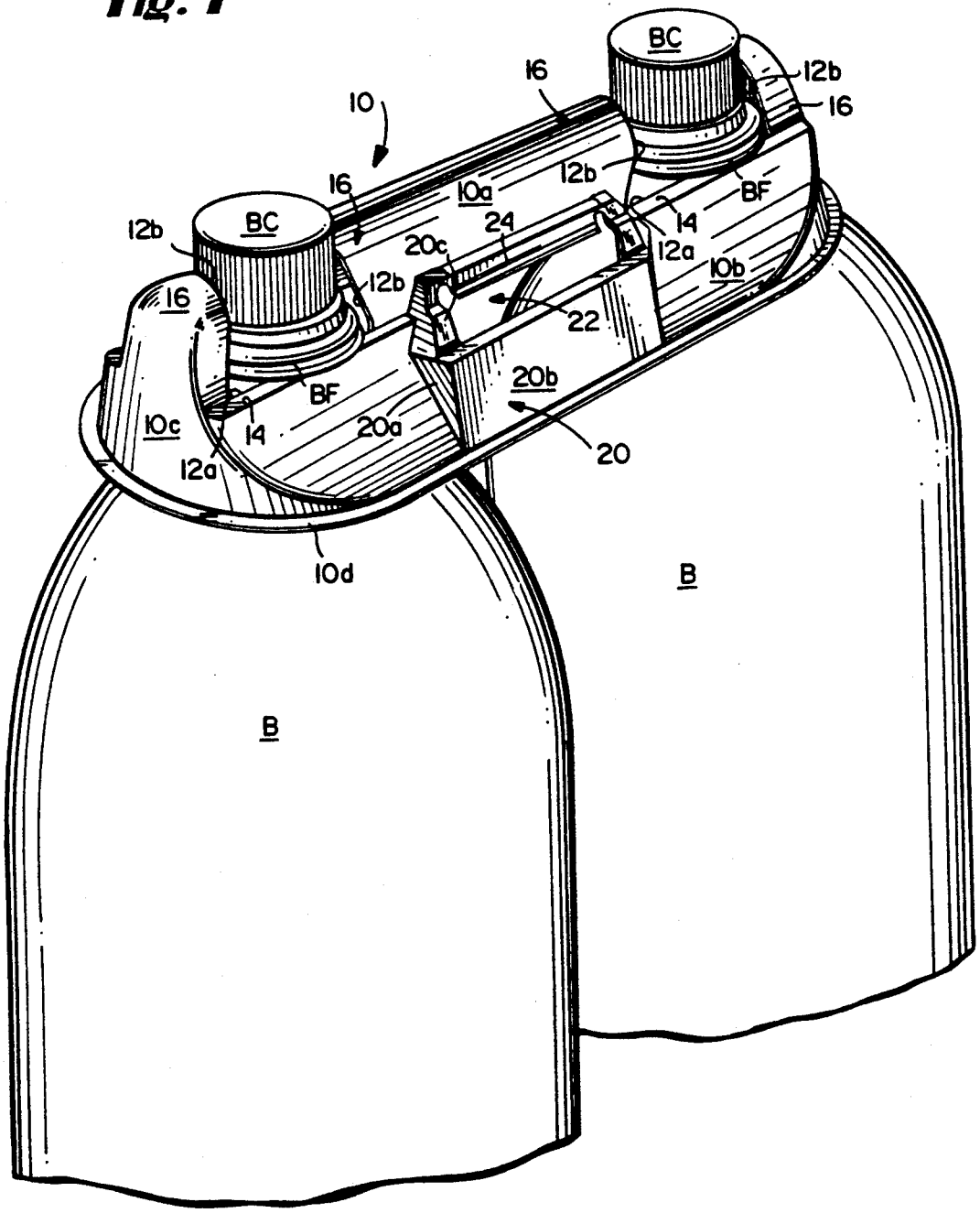
FIG. 1 is an in-service perspective view of a multiple bottle carrier according to this invention.

Accompanying FIG. 1 shows a preferred embodiment of a carrier 10 according to this invention in service for carrying a pair of identical bottles B. It should be mentioned here that the carrier 10 of this invention is not limited to any particular number of bottles which may be carried thereby. The structures and functions of the carrier 10 could thus be embodied in a carrier device which is adapted to carrying many more bottles B than are actually shown in the accompanying FIGURES. The decision as to the number of bottles which the carrier 10 is designed to accomodate will be dependent on a number of practical considerations, such as the most desirable multi-bottle unit packaging for consumer needs, the weight of such unit packaging, and the like.

The bottles B are of a conventional variety which are currently being used as beverage containers. In this regard, the bottles B will typically be formed of a plastics material (but glass bottles could also be employed) and will have a bottle cap BC closure for the opening. These conventional bottles will, moreover, have an annular bottleneck flange BF immediately below the bottle cap BC. As will be described in greater detail below, the carrier 10 according to the present invention will support the bottles B by their respective bottleneck flanges BF.

Figure 2:
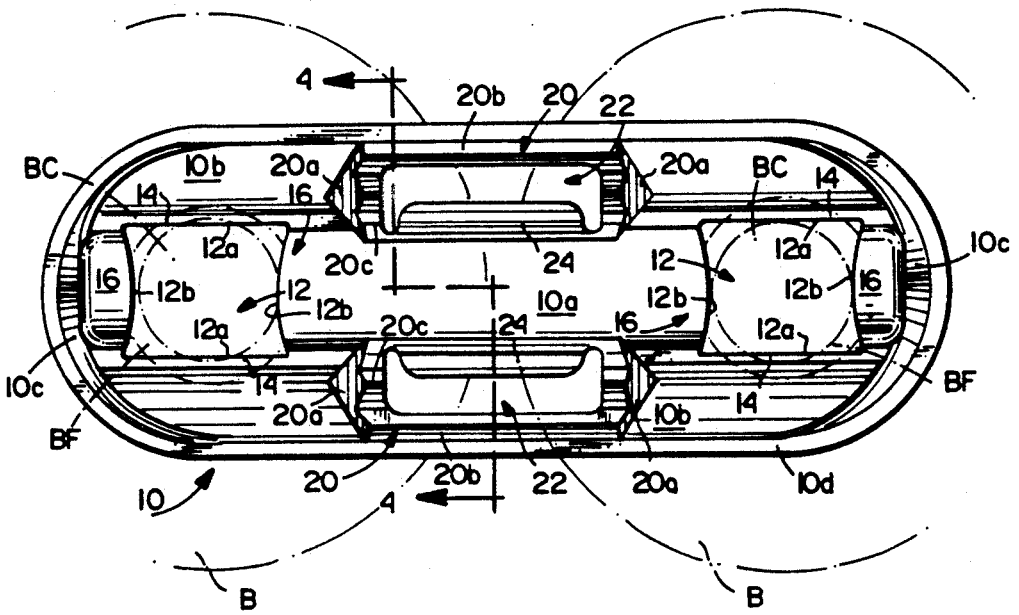
FIG. 2 is a top plan view of the multiple bottle carrier according to this invention.
Figure 3:
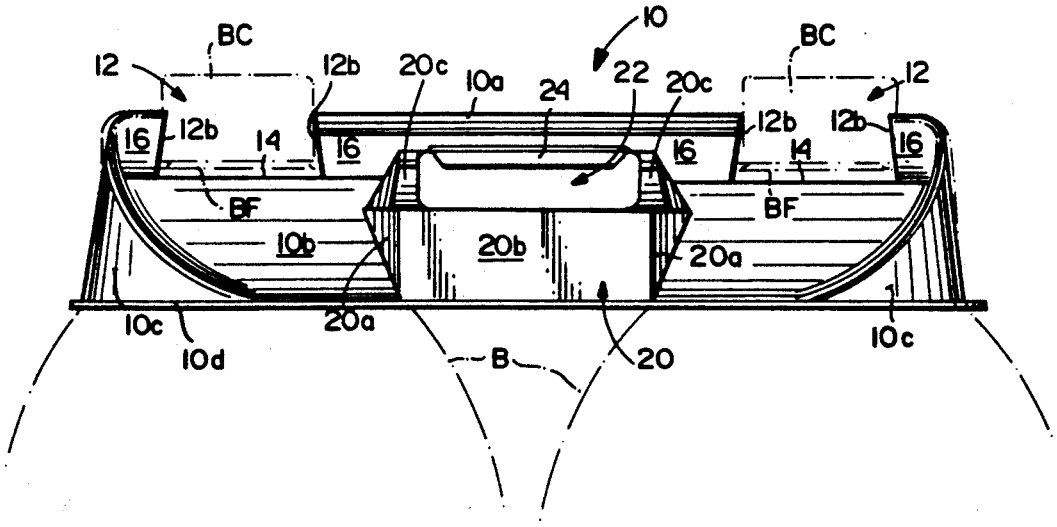
FIG. 3 is a side elevation view of the multiple bottle carrier shown in FIG. 2.
Figure 4:
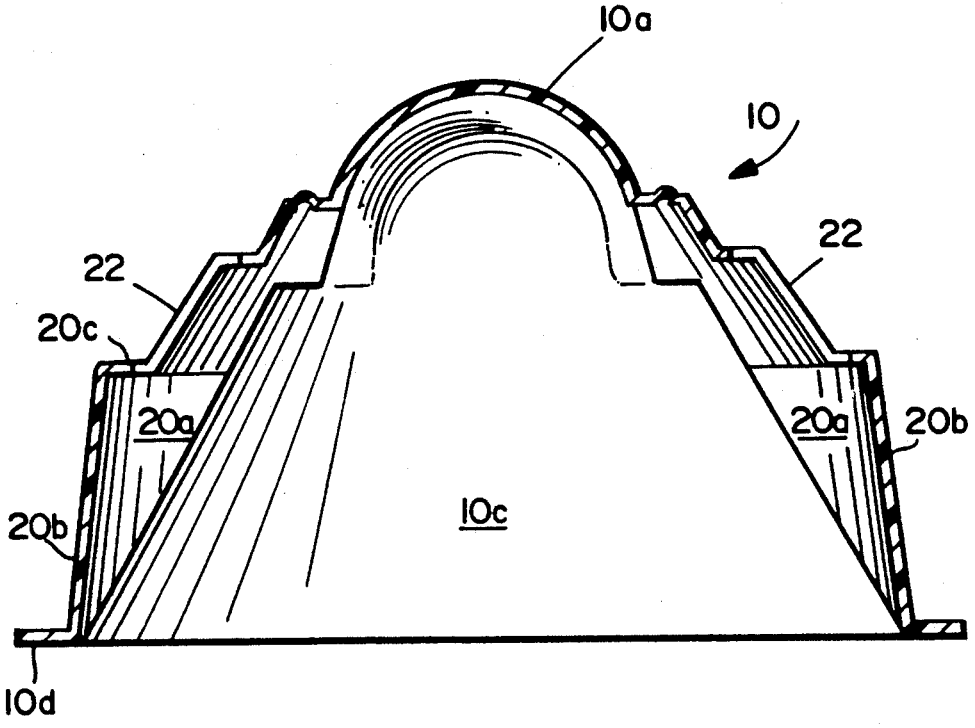
FIG. 4 is cross-sectional elevational view of the multiple bottle carrier shown in FIG. 2 as taken along line 4—4 therein.

As is perhaps more clearly shown in accompanying FIGS. 2–4, the carrier 10 according to this invention in the form of an elongate inverted cup-shaped carrier body structure having an arcuate upper wall 10*a*, and opposed pairs of tapered side and arcuate end walls 10*b* and 10*c*, respectively. The side and end walls 10*b* and 10*c*, respectively, thus provide a skirt which covers an upper shoulder region of the bottles B. An outwardly extending stiffener flange 10*d* extends around the periphery of the carrier 10 along the bottom edges of the side and end walls 10*b* and 10*c*, respectively, so as to increase the structural stiffness of the carrier 10 and thereby stabilize the bottles B when carried thereby.

Bottleneck-receiving apertures 12 are formed in the carrier 10 and are separated along the carrier's lengthwise dimension. Each of the apertures 12 is defined by the inner edges 12*a* of an opposed pair of generally horizontal support surfaces 14, and an opposed pair of edges 12*b* associated with a corresponding pair of resilient locking fingers 16. As is shown in FIG. 3, for example, the edges 12*b* associated with the locking fingers 16 extend upwardly from the support surfaces 14 and converge towards one another near the upper wall 10*a* of the carrier 10—that is, the separation distance between the edges 12*b* of each aperture 12 is less at near upper wall 10*a* as compared to the separation distance between the edges 12*b* near the support surfaces 14.

Reinforcement of the central portion of the side walls 10*a* is provided by a lateral projection 20 formed of an opposed pair of terminal end walls 20*a*, a lateral wall 20*b* and a top wall 20*c*. These lateral projections provide increased structural integrity to the central portion of carrier 10 and thereby help to ensure that the carrier 10 will not collapse about its latitudinal axis under the weight of the beverage bottles B. In addition, the lateral projections 20 allow for convenient placement of lengthwise extending finger openings 22 which are formed in the top walls 20*c* of lateral projection 20. The upper edge of each finger opening 22 is most preferably provided with a cushion flap 24 which serves to minimize discomfort to a person's fingers when the carrier/bottle package is being carried.

In service, carrier/bottle package will be provided at the point of sale as a convenient way for consumers to purchase and then carry multiple beverage bottles. That is, the beverage bottler will preposition the beverage bottles B within each of the apertures 12 such that the annular bottleneck flange BF of the bottles B is disposed above and rests upon the support surfaces 14. When the carrier/bottle package is lifted (for example, by a person inserting his or her fingers into the openings 22), the weight of the bottles B will be borne by the support surfaces 14. The influence of the bottle weight will thus cause the support surfaces 14 to bow slightly downwardly which, in turn, urges the resilient locking fingers 16 inwardly towards one another. As a result, the locking fingers 16 reliably grip the bottle cap and/or the bottleneck so as to couple the carrier 10 to the bottles B. When the bottles are again brought to rest, the support surfaces will resiliently return to their non-bowed condition which allows the locking fingers to return to their normal state. As a result, the bottles B may easily be removed from the carrier 10 so their contents can be consumed.

The arcuate upper wall 10*a* of the carrier body structure serves as a convenient handle for grasping and carrying the bottle carrier 10 and the bottles B attached thereto. In this regard, it will be appreciated that when the carrier 10 is grasped at the arcuate upper wall 10*a*, there will be a tendency for the upper wall 10*a* to be compressively squeezed. As a result, an inwardly directed radial pinch force will be exerted against the bottle neck by the inner edges 12*a* of apertures 12 thereby providing a positive gripping force which assists in reliably coupling the carrier 10 to the bottles B during transit.

Coupling forces between the carrier 10 and the bottles B are also provided by virtue of flange 10*d* bearing against the shoulder region of the bottles B. That is, the vertical dimension between parallel horizontal planes established by the flange 10*d* and the support surfaces 14 is slightly greater than what is needed to span the vertical dimension between the shoulder region of the bottle B and the bottle neck flange BF. As a result, the carrier body structure is compressed somewhat in the region between the bottle neck flange BF and the bottle's shoulder region. This compression will, in turn, cause the support surfaces 14 to exert an upward bias force against the bottle neck flanges BF thereby enhancing the coupling integrity between the carrier 10 and the bottles B.

Although the carrier 10 is presently intended to be a disposable item, it could be reused by consumers as a convenient means to carry beverage bottles which are sold separately (i.e., not as part of a carrier/bottle package). In addition, the carrier 10 could be used conveniently as a means to organize empty bottles for purposes of recycling the plastics materials from which the bottles and the carrier are made.

It will be appreciated that the carrier 10 according to this invention is capable of carrying virtually any bottle structure (regardless of bottle material) currently on the market provided that the bottle has a neck region and a flange BF associated with that neck region. Thus, the bottle carrier 10 of this invention is universal to the extent that virtually any bottle having this required structure can be reliably carried.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed

1. A multiple bottle carrier comprising a one-piece carrier body which includes:

an upper wall, and opposed pairs of side and end walls;

lateral reinforcement projections formed in said opposed pair of side walls of said carrier body;

a plurality of bottleneck-receiving apertures formed in said carrier body and corresponding in number to the bottles to be carried;

an opposed pair of substantially horizontal support surfaces associated with each said aperture for supporting an annular bottleneck flange of a bottle received in said aperture and thereby supporting the bottle when carried by the carrier; and a pair of opposed resilient fingers also associated with each said aperture, said fingers extending upwardly from said support surfaces to a location above the bottleneck flange when the bottle is received in the aperture, and converging towards one another so as to removably lock the bottle to the carrier.

2. The carrier as in claim 1, wherein each said aperture is bounded by respective edges of said opposed support surfaces and locking fingers.

3. The carrier as in claim 1, further comprising finger openings formed in the side walls of said carrier body.

4. The carrier as in claim 3, wherein said finger openings include a cushion flap.

5. The carrier as in claim 4, wherein said cushion flap extends along an upper edge of said finger openings.

6. A self-locking bottle carrier adapted to hold a number of bottles of the type having an annular neck flange protruding outwardly therefrom, and to thereby allow the bottles to be collectively carried, said bottle carrier comprising:

a one-piece carrier body having an upper wall, and opposed pairs of side and end walls, said carrier body also having a number of bottle-receiving apertures, said carrier body including lateral reinforcement projections formed in said opposed side walls;

said bottle receiving apertures being defined by:

(i) a pair of opposed, generally horizontal support surfaces; and (ii) an opposed pair of resilient locking fingers extending upwardly from respective ends of said support surfaces and converging towards one another so that an upper dimension of said aperture between opposed locking fingers is less than a lower dimension of said aperture between said locking fingers near said support surfaces; wherein (iii) the bottleneck flange is supported by said support surfaces and the weight of the bottle and its contents cause said horizontal surfaces to bow slightly downwardly thereby urging said opposed locking fingers inwardly towards one another, whereby the bottle is removably coupled to the carrier.

7. The carrier as in claim 6, wherein each said aperture is bounded by respective edges of said opposed support surfaces and locking fingers.

8. The carrier as in claim 6, further comprising finger openings formed in the side walls of said carrier body.

9. The carrier as in claim 8, wherein said finger openings include a cushion flap.

10. The carrier as in claim 9, wherein said cushion flap extends along an upper edge of said finger openings.

11. A multiple bottle carrier comprising:

a one-piece carrier body having an upper wall, a pair of opposed side walls which are joined to said upper wall along and which divergingly extend therefrom, and a pair of opposed generally convexly shaped end walls joined to said side walls and said upper wall;

said side and end walls collectively establishing a continuous bottom edge of said carrier body which establishes an opened bottom cavity of said carrier body to receive an upper shoulder region of bottles to be carried thereby;

a number of bottleneck-receiving apertures formed in said carrier body and corresponding in number to the bottles to be carried;

an opposed pair of substantially horizontal support surfaces associated with each said aperture for supporting an annular bottleneck flange of a bottle received in said aperture and thereby supporting the bottle when carried by the carrier;

a pair of opposed resilient fingers also associated with each said aperture, said fingers extending upwardly from said support surfaces to a location above the bottleneck flange when the bottle is received in the aperture, and converging towards one another so as to removably lock the bottle to the carrier; and a perimetrical bottom flange joined to and extending along said bottom edge of said carrier body, said bottom flange contacting said upper shoulder regions of the bottles carried thereby to compress the carrier body in the region between the support surfaces and the bottom flange which, in turn, causes the support surfaces to exert an upward bias force against the bottleneck flanges of bottles supported thereby.

12. The carrier as in claim 11, wherein each said aperture is bounded by respective edges of said support surfaces and locking fingers.

13. The carrier as in claim 11, further comprising finger openings formed in the side walls of said carrier body.

14. The carrier as in claim 13, wherein said finger opening include a cushion flap.

15. The carrier as in claim 14, wherein said cushion flap extends along an upper edge of said finger openings.

16. The carrier as in claim 11, further comprising lateral reinforcement projections formed in said side wall of said carrier body.

17. The carrier as in claim 11, wherein said upper wall of said carrier body is arcuate, and wherein a pair of finger openings is formed in said opposed pair of side walls near said upper wall, said upper wall thereby serving as a handle for said carrier body.

* * * * *